US007863829B2

(12) United States Patent
Sayers et al.

(10) Patent No.: US 7,863,829 B2
(45) Date of Patent: Jan. 4, 2011

(54) LED LIGHTING SYSTEM

(75) Inventors: Graham Sayers, Framingham, MA (US); Moneer Azzam, Wellesley, MA (US); Joseph Bernier, Cambridge, MA (US); Martin Fox, Storrs, CT (US); Robert F. Karlicek, Jr., Chelmsford, MA (US); Thomas M. Lemons, Marblehead, MA (US)

(73) Assignee: SolarOne Solutions, Inc., Framingham, MA (US)

( * ) Notice: Subject to any disclaimer, the term of this patent is extended or adjusted under 35 U.S.C. 154(b) by 1263 days.

(21) Appl. No.: 11/323,005

(22) Filed: Dec. 30, 2005

(65) Prior Publication Data

US 2006/0149607 A1 Jul. 6, 2006

Related U.S. Application Data

(60) Provisional application No. 60/640,375, filed on Dec. 30, 2004.

(51) Int. Cl.
*H05B 37/02* (2006.01)

(52) U.S. Cl. ..... 315/291; 315/153; 315/302; 315/312

(58) Field of Classification Search ..... 315/312, 315/360, 362, 307, 291, 178, 179, 149, 153, 315/154, 302; 362/208, 800, 285; 323/905, 323/906; 345/76–83
See application file for complete search history.

(56) References Cited

U.S. PATENT DOCUMENTS

| | | | | |
|---|---|---|---|---|
| 5,801,519 | A * | 9/1998 | Midya et al. | 323/222 |
| 6,211,626 | B1 * | 4/2001 | Lys et al. | 315/291 |
| 6,636,003 | B2 * | 10/2003 | Rahm et al. | 315/179 |
| 7,202,613 | B2 * | 4/2007 | Morgan et al. | 315/312 |
| 2003/0117822 | A1 * | 6/2003 | Stamenic et al. | 363/132 |
| 2005/0099824 | A1 * | 5/2005 | Dowling et al. | 362/572 |
| 2005/0146874 | A1 * | 7/2005 | Cech et al. | 362/253 |
| 2006/0158881 | A1 * | 7/2006 | Dowling | 362/231 |

* cited by examiner

*Primary Examiner*—Douglas W Owens
*Assistant Examiner*—Ephrem Alemu
(74) *Attorney, Agent, or Firm*—McCormick, Paulding & Huber LLP

(57) ABSTRACT

A method for optimizing an LED lighting system cost includes steps of determining LED costs, power source costs, and total costs associated with a plurality of LED quantities, and identifying a lowest total cost as an optimal cost. A LED lighting system includes an LED operated by a constant-current driver at less than its maximum current capacity. A programmable controller including a feedback routine is used to compensate for intensity drift as an LED ages. Other embodiments of LED lighting systems include multiple LEDs producing light having various spectrums to optimize the lighting system efficiency and the effectiveness. A charge controller including an MPPT routine is advantageously employed with a LED lighting system powered by a limited-capacity power source.

18 Claims, 8 Drawing Sheets
(1 of 8 Drawing Sheet(s) Filed in Color)

LED LIGHTING SYSTEM

The present application claims the benefit of U.S. Provisional Application No. 60/640,375, filed on Dec. 30, 2004, the contents of which are herein incorporated by reference in their entirety.

FIELD OF THE INVENTION

The present invention relates to light emitting diode ("LED") lighting systems, and particularly to LED lighting systems intended for use with power sources having a limited storage capacity.

BACKGROUND OF THE INVENTION

As energy costs rise and the cost of producing LEDs fall, LED lighting systems are increasingly looked to as a viable alternative to more conventional systems, such as those employing incandescent, fluorescent, and/or metal-halide bulbs. One long-felt drawback of LEDs as a practical lighting means has been the difficulty of obtaining white light from an LED. Two mechanisms have been supplied to cope with this difficulty. First, multiple monochromatic LEDs were used in combinations (such as red, green, and blue) to generate light having an overall white appearance. More recently, a single LED (typically blue) has been coated with a phosphor that emits light when activated, or "fired" by the underlying LED (also known as phosphor-conversion (PC) LEDs). This innovation has been relatively successful in achieving white light with characteristics similar to more conventional lighting, and has widely replaced the use of monochromatic LED combinations in LED lighting applications. Monochromatic LED color combinations are commonly used in video, display or signaling applications (light to look at), but almost never used to illuminate an area (light to see by). As even a relatively dim light can be seen, the luminous intensity generated by LEDs in video or display applications is not a major concern.

PC LEDs, however, are highly expensive to produce relative to more conventional bulbs (as are LEDs, generally) and efficiency and longevity gains of PC LEDs (PC LEDs produce light less efficiently than monochromatic LEDs due to the two-step process required to generate the white light) were not perceived to offset the high initial costs, except in applications where efficiency and longevity were more highly valued. Such applications include lighting systems powered by limited-capacity power sources, such as batteries, and particularly systems with batteries charged by "off-grid" energy sources such as photovoltaic ("PV") panels, wind turbines, and small hydro-turbines. Even when LEDs (particularly, PC LEDs) were used in a LED lighting system, the practice (until the present invention) has been to use as few LEDs as necessary to achieve the desired luminance by operating each LED at its maximum current capacity.

In connection with the increasing use of LEDs for certain lighting applications, two methods of allowing a user to control the intensity of LEDs have been developed (though in many applications, such a simple LED flashlight, no intensity adjustment can be made by the user). The first, simply varying the forward current (like most diodes, LEDs only allow current to pass in one direction) passing through the LED, has largely been used only in applications where efficiency and/or precise selection of a range of luminous intensities is not a concern (e.g., in an automotive brake light where only two intensity levels are desired and the automobile's alternator generates far more electricity than is required to power the LED brake light). Typically, a voltage divider circuit with one or more variable resistors is used to vary the voltage drop across the LED, which in turn results in a proportionally varied current. Such a method of controlling luminous intensity is inefficient because the power dissipated in the resistor is simply lost, thus reducing the overall efficiency, particularly when lower currents are being supplied. However, the costs of these relatively simple circuits can be significantly less than the constant-current drivers discussed below.

In applications where more precise intensity control is desired (e.g., many, though not necessarily all, lighting system applications), or greater efficiency is required (e.g., systems for use with a limited-capacity power source, such as a PV panel and/or battery) a constant-current driver (CCD) is used to supply a substantially constant current to the LED, regardless of the supplied voltage. It is possible to supply a substantially constant current using "passive" components (e.g., resistors and capacitors, and the like), though these passive means do not necessarily yield efficiency increases over simpler voltage divider circuits because power losses are still associated with the passive components. The more efficient constant current control is typically achieved by "active" switching, in which actively controlled components (e.g., internal, gated, bi-polar transistors (IGBTs), and the like) are used to supply the substantially constant current without the losses associated with passive components.

In constant current systems, the luminous intensity of the LED is varied, typically, by using a pulse-width modulated (PWM) control signal to vary the duty cycle with which the CCD supplies the substantially constant current to the LED. When the PWM control signal has a frequency of over approximately 100 Hz, the cycling of the LED is not visually perceivable. For example, a PWM control signal with a frequency of 1000 Hz will turn the LED ON and OFF 1000 times per second. If 50% intensity is desired, the PWM control signal will provide for ON and OFF periods of equal duration. For 75% intensity, the ON periods will be three times longer than the OFF periods. For 25% intensity, the OFF periods will be three times longer than the ON periods. No flashing or occulting will be perceivable to the human eye because of the high frequency. Instead, the eye will perceive a constant, but diminished, intensity as the duty cycle is decreased from 100% intensity. (Intensity, as used herein, refers to luminous intensity, and may be perceived and/or actual, unless otherwise specified.) In conventional PWM lighting, selecting the maximum intensity (no OFF periods) will result in all LEDs operating at a maximum rated current.

To maximize the power available from a limited-capacity power source, such as a PV panel and battery system, charge controllers for batteries have been employed using a technique known as Maximum Power Point Tracking ("MPPT"). MPPT maximizes the charge rate when power generation conditions are sub-optimal (e.g., for a PV panel, a day with relatively few day-light hours). MPPT charge controllers are very expensive and have previously been used only in relatively high current systems (with charging currents over 20 amps) and not in connections with limited-capacity power sources used to power lighting systems (in which the charging current is typically less than 10 amps), as the efficiency gains in lower current systems were considered to be proportionally lower, and would not offset the added cost of a MPPT charge controller.

SUMMARY OF THE INVENTION

The present inventors have discovered that a substantial gain in efficiency is realized by operating LEDs at lower power levels. This substantial gain in efficiency was unexpected and surprising. Determining the true efficiency increase associated with LEDs operating at lower powers was particularly difficult because most commercially-available LED arrays contain "built-in" balancing resistors. A side-effect of such resistors is to create an artificial efficiency peak where circuit impedances were matched, resulting in artificially low luminous efficiencies at lower power levels. This discovery has come about as a result of analysis of a series of measurements obtained by driving both commercially-available and specially-made (without balancing resistors) PC LED light arrays at various current levels up the maximum rated current and calculating the luminous efficiency of the LED arrays at each current. An LED's luminous efficiency is defined as the efficiency with which an LED converts electrical power into light. For example, an LED that produces 20 lumens/watt has a lower luminous efficiency than an LED that produces 25 lumens/watt. Analysis of these measurements has shown that operating LEDs at a current below 35% of the maximum current capacity achieves efficiency gains of over 40%.

Accordingly, to achieve a given luminous intensity, or lumen rating, in an LED lighting system it is substantially more luminously efficient to use more PC LEDs operated at a lower current than it is to use a fewer LEDs operated at higher currents. Looked at another way, a limited-capacity power source can be used to achieve a greater luminous efficiency by operating a larger quantity of LEDs at a lower current. Based on this analysis of luminous efficiency, and based on current costs associated with increasing power source capacity (e.g., battery capacity, PV panel size, etc.) relative to the costs of increasing the number of LEDs, the present inventors have determined an optimal operating current level to be in the range of 50% and lower of the LEDs maximum current capacity. As the cost of LEDs decline with volume production and technical developments relative to the cost of energy, the optimal current drops to the 35% and lower.

A method for optimizing an LED lighting system cost, according to the present invention, includes steps of determining first and second LED costs associated with first and second LED quantities, determining first and second power source costs associated with the LED quantities, determining first and second total costs associated with first and second LED quantities, the total costs including the LED costs and the power source costs, and selecting as optimal the LED quantity associated with the lower total cost, wherein a first luminous efficiency associated with operating said first LED quantity and a second luminous efficiency associated with operating said second LED quantity are considered in determining at least one of said first and second LED costs, said first and second power source costs, and said first and second total costs.

A LED lighting system, according to an embodiment of the present invention, includes at least one LED having a maximum current capacity, and at least one constant-current driver for supplying a substantially constant current to the at least one LED, whereby luminous efficiency of the LED lighting system is increased.

The intensity of an LED tends to drift over its design lifetime. Intensity drift is defined as a change in intensity of LED at a given current which is not due to a change in any characteristic of the power supplied to an LED (e.g., duty cycle, frequency, supplied current, and the like). Typically, an LED will gradually lose intensity, for a given current, as the LEDs age. Given the very long design life of LEDs (typically, several years), an LED lighting system, according to another embodiment of the present invention, has a feedback means to detect the intensity of an LED. The programmable controller includes an intensity compensation routine for adjusting the intensity to compensate for intensity drift as the LED ages, based on the intensity detected by the feedback means.

The present inventors have also discovered that adjusting the various color constituents of a multiple-color LED lighting system enhances both the efficiency and effectiveness of an LED lighting system under a range of ambient light conditions. These advantageous adjustments of the various color constituents are particularly well-suited for use in connection with LED lighting systems using CCDs for control of luminous intensity, though other current control means may also be used. The response of the human eye to various wavelengths of light differs depending on the ambient light conditions. This varying response is at least partially due to the two basic light-receptive structures in the eye, rods and cones. Cones tend to be more active in brightly-lit ambient conditions, whereas rods are more active in dimly-lit ambient conditions. FIG. 1 illustrates the response of the eye under a range of ambient lighting conditions. In relatively dark, or scotopic, ambient conditions, below approximately $1\times10^2$ candellas/meter squared (cd/m$^2$), the rods predominate. In relatively bright, or photopic, ambient conditions, above approximately $1.0\times10^1$ cd/m$^2$ the cones predominate. Between scotopic and photopic conditions are mesopic conditions, in which optical response is largely due to the combined response of rods and cones.

Cones are generally regarded as more sensitive to color differences whereas rods are more sensitive to the absence or presence of light. This is why animals with more acute night vision, such as cats, have eyes containing a relatively greater proportion of rods and are generally thought to be less capable of distinguishing colors. However, while the perception of color may be diminished in scotopic conditions, the rods are more sensitive to certain colors of light. The same is true of cones. As a result, the overall intensity of light perceived by the eye under both scotopic and photopic conditions is not simply a result of the intensity of the source, but also a function of the wavelength of the light produced by the source. As seen in FIG. 2, in scotopic conditions, the eye is most sensitive to light with wavelengths between approximately 450 nm to approximately 550 nm, with a peak sensitivity at approximately 505 nm. In photopic conditions, the eye is most sensitive to light with wavelengths between approximately 525 nm to approximately 625 nm, with a peak sensitivity at approximately 555 nm.

When the luminous intensities of variously colored LEDs is determined, this relationship is obscured, particularly with regards to scotopic effectiveness, because luminance has an inherently subjective component, as a luminance measurement is based on the photopic response of the human eye. The subjectivity of this measurement helps explain why lamps with relatively high lumen ratings, such as various sodium lamps (low-pressure sodium lamps and high-pressure sodium lamps) appear dim and harsh at night even though they possess a high lumen rating. A sodium lamp typically generates a very yellow light with a wavelength of approximately 600 nm. In dim mesopic or scotopic ambient conditions, the rods are more active, thus rendering the eye, in those conditions, less sensitive to the light being produced by the sodium lamp. Since typical nighttime outdoor lighting (pathway lighting, parking lot lighting, area lighting, and the like) are generally only designed for an intensity of approximately 0.5 cd or less, energy in such systems is largely wasted when used to produce light whose intensity will go largely unperceived by the eye due to an overly-high wavelength. Similarly, under photopic conditions, energy is less efficiently used to drive colors having relatively low wavelengths in a multi-color constituent lamp.

Accordingly, a LED lighting system producing a combined spectrum, according to a further embodiment of the present invention, includes, a first LED producing light having a first spectrum and an adjustable first intensity, a second LED producing light having a second spectrum and an adjustable second intensity, a programmable controller for independently adjusting said first and second intensities.

The efficiency and effectiveness of such a system is further enhanced, in another aspect of the present invention, by including a light detection means for detecting an ambient light condition, wherein said programmable controller includes a spectrum adjustment routine for adjusting at least one of said first and second adjustable intensities to produce an overall spectrum in response to said ambient light condition.

The efficiency of a LED lighting system is also enhanced, in a further aspect of the present invention, wherein said first LED has a greater luminous efficiency than said second LED, and said programmable controller includes an efficiency enhancement routine for increasing an overall efficiency of said LED lighting system by operating said first LED at a higher intensity relative to said second LED.

An additional aspect of the present invention includes a feedback means for independently detecting an actual first intensity and an actual second intensity of said first and second LEDs, respectively, and communicating said actual first and second intensities to said programmable controller, wherein said programmable controller includes a feedback routine for using said actual first and second intensities as feedback for adjusting said adjustable first and second intensities.

In a yet another aspect of the present invention, the programmable controller includes an information routine for adjusting an overall spectrum produced by said system to convey information to a user of said system by said system by adjusting at least one of said first and second intensities Utilizing the scotopic and photopic properties of the human eye, according to a further embodiment of the present invention, a LED lighting system includes a first LED producing light having a first spectrum substantially corresponding to one of a peak scotopic and a peak photopic sensitivity of a human eye, and a second LED producing light having a second spectrum.

Given the potentially long distances that may exist between the LEDs, the constant current driver and the programmable controllers in LED lighting systems, an additional embodiment of the present invention further optimizes the efficiency and effectiveness of such systems by providing an LED assembly, including an LED and a current control menas, and a programmable controller adapted for optical communications and a fiber optic line for carrying optical communications between the two. Additional fiber optic lines are provided for optical communications between the programmable controller and other system components.

According to another embodiment of the present invention, An LED lighting system comprising a least one LED, a battery, a limited-capacity power source for charging said battery, a charge controller including an MPPT routine for maximizing the rate at which said power source charge said battery in sub-optimal charging conditions.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1:
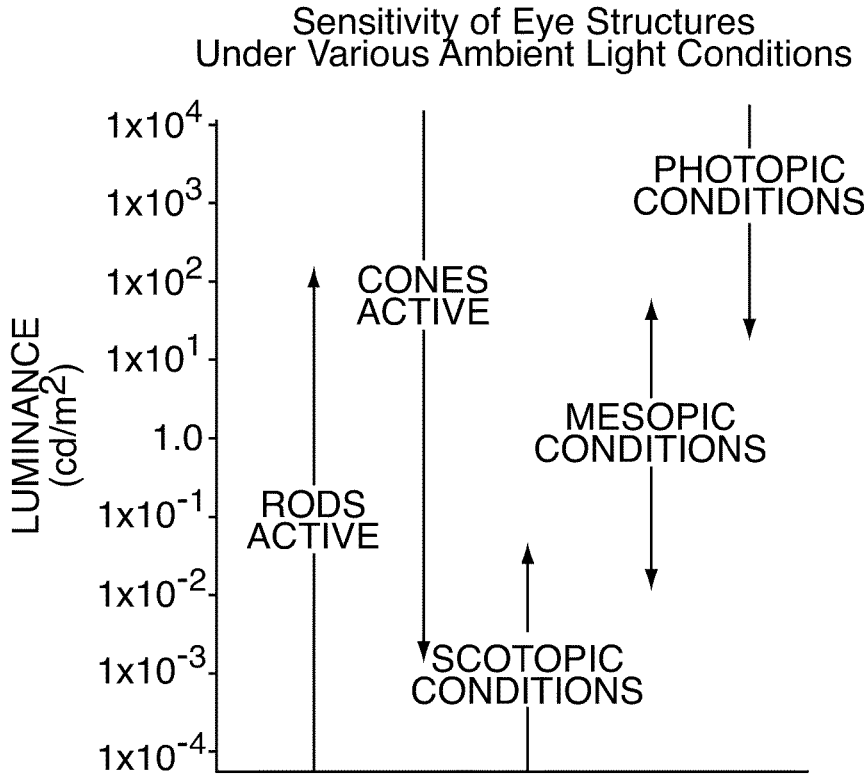
FIG. 1 illustrates the sensitivity of the human eye under various ambient light conditions.
Figure 2:
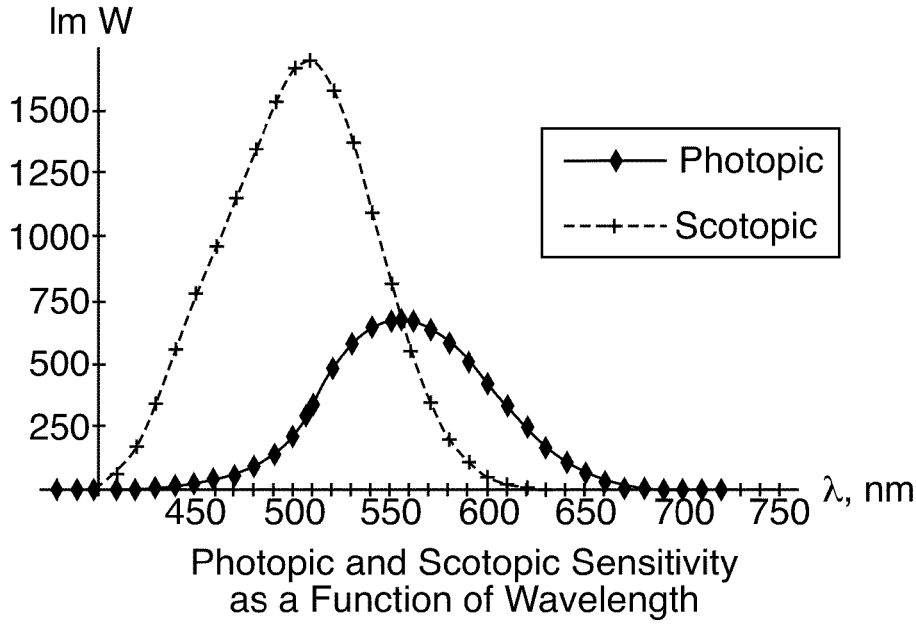
FIG. 2 illustrates the sensitivity of the human eye as a function of wavelength.

To optimize the cost of an efficient LED lighting system, the cost of various LED quantities is determined. A useful way to determine the costs of two or more LED quantities is as a variable cost of the LEDs as the quantity of LEDs increases, expressed as a variable cost per lumen. The per lumen variable cost is the total cost of the LEDs divided by the lumens produced the LEDs.

In practice, LEDs are typically arranged in series strings and additional LEDs are added by including additional series strings. LEDs in lighting systems are typically arranged in series strings based on an optimal system operating voltage. A typical LED can be safely operated (with its maximum current rating) at 3 to 4 volts DC (VDC). Systems considered "low voltage" must not exceed 50 volts anywhere in the system. Furthermore, electronic components rated below 32 VDC often come at a lower cost than components with a higher voltage rating. Under these constraints, an LED string voltage of approximately 30 volts is most desirable. If less than approximately 8 LEDs are used in series, relatively large current-limiting resistors, or the like, are required to reduce the current to an acceptable level. As power being dissipated by the resistors is power not being used to produce light, matching the number of LEDs to the output voltage of the power source enhances the efficiency of the system. As a result, increasing the number of LEDs in an LED lighting system typically requires LEDs to be added in series strings of multiple LEDs, usually of approximately 8, and not just incremental additions of single LEDs.

Additionally, adding additional series strings requires either additional intensity adjustment means for the additional strings or more complex intensity adjustment means. This additional, LED-associated circuitry will result in additional LED variable costs as the number of LEDs is increased.

As previously discussed, operating LEDs at a lower current yields an efficiency gain. Eight LEDs operated at maximum rated current will result in a lower overall luminous intensity than 16 LEDs operated at one-half of the maximum rated current. Accordingly, LED per lumen cost increases associated with adding additional LEDs are offset to some extent by the increase in overall luminous intensity. Alternatively, a comparison can be made of the relative costs for obtaining a given overall luminous output, in which case the LED per lumen cost increases due to the costs associated with additional LEDs are not offset, but a greater increase in luminous efficiency is realized.

It is also necessary to determine the cost of the power source necessary to power each quantity of LEDs. These costs may also be determined as a variable cost of the power source, commonly expressed as a per watt variable cost. In the case of a limited-capacity power source, the limited-capacity power source typically includes a power generation means and a power storage means. For example, in a solar-powered lighting system, one or more PV panels would serve as the power generation means and one or more batteries would serve as the power storage means. In such a solar-powered lighting system, the per watt variable cost includes a per watt variable cost for PV panels and a per watt-hour variable cost for battery storage capacity.

The variable costs associated with various LED quantities and the components of a power source, or limited-capacity power source, can also be expressed in terms of other units, for instance, a per amp-hour cost for battery storage. Since the ultimate goal is to arrive at a total cost, or total cost per lumen produced, for LED lighting systems with various quantities of LEDs, it may be helpful to express the variable costs with consistent units to aid in the comparison. For instance, a per watt variable cost for a power source may be converted to a per lumen cost by dividing the per watt variable cost by the luminous efficiency of the system with a given quantity of LEDs, expressed as lumens per watt.

Figure 3:
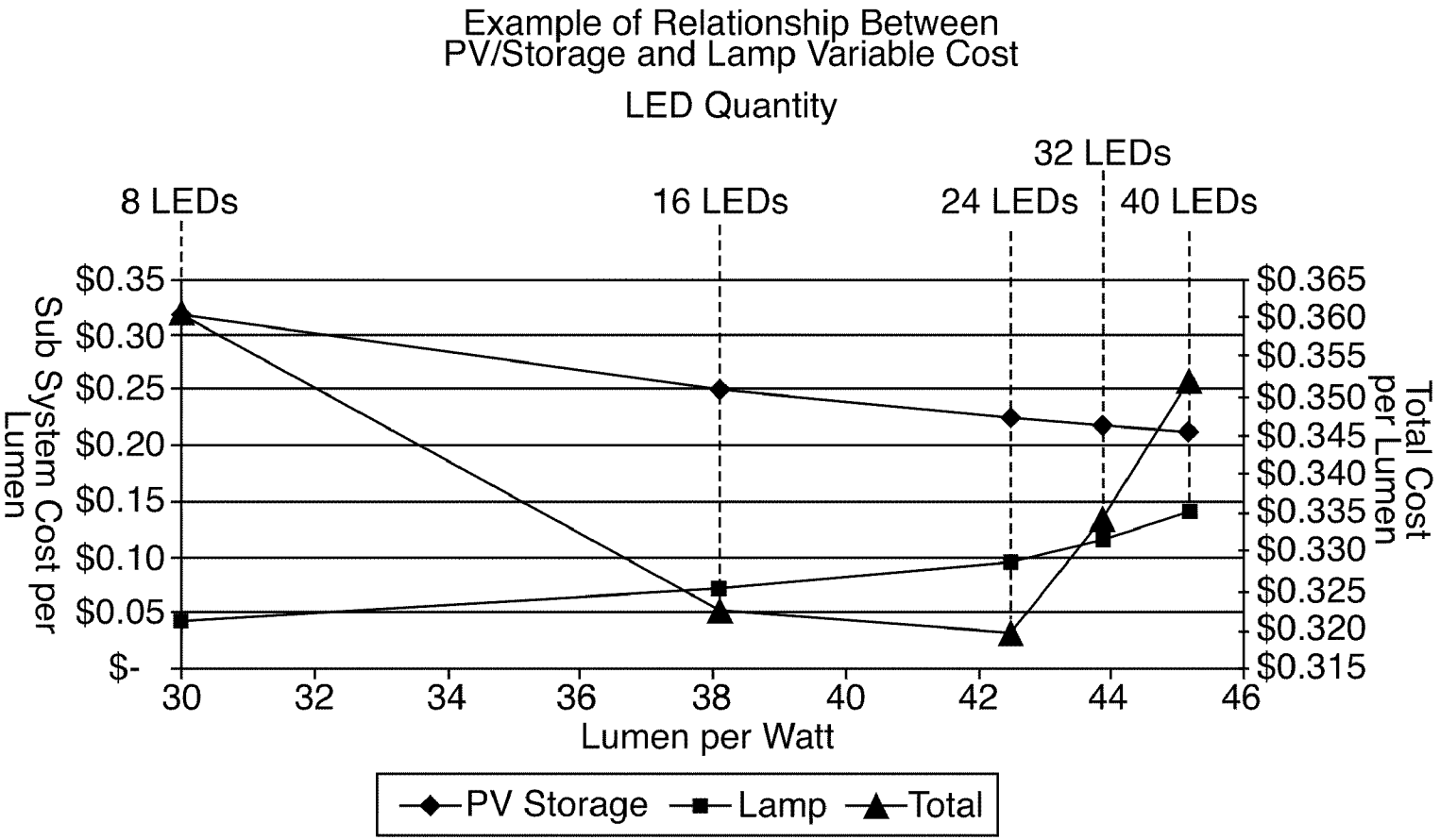
FIG. 3 illustrates a cost optimization for a LED lighting system obtained according to a method of the present invention.

When the LED costs and the power source costs are totaled for each quantity of LEDs, the optimal quantity of LEDs is identified as the LED quantity corresponding to the lowest total cost, which may be expressed as a lowest total cost per lumen. An example of this comparison, based on current pricing of LED lighting system components for a solar powered lighting system can be seen in FIG. 3. In FIG. 3, it can be seen that the per lumen costs of adding LEDs increases continuously from 8 to 40 LEDs. The per lumen costs of the PV panel and battery storage associated with each quantity of LEDs decreases continuously, due to the enhanced luminous efficiency (i.e., a smaller PV panel and/or battery is sufficient to achieve a given luminous intensity). An optimal quantity of LEDs, in the example of FIG. 3, is 24 LEDs, as the total cost per lumen is lowest with that quantity of LEDs.

As the current trend is for LEDs to be produced less and less expensively (with no corresponding decrease in power source costs), the variable cost of adding LEDs may be expected to decrease, and use of the method of the present invention will tend to result in the selection of even larger, and more efficient, quantities of LEDs as optimal for LED lighting systems. This is particularly the case with limited capacity power sources, such as solar systems where the costs of PV panels and battery storage are relatively high.

Figure 4:
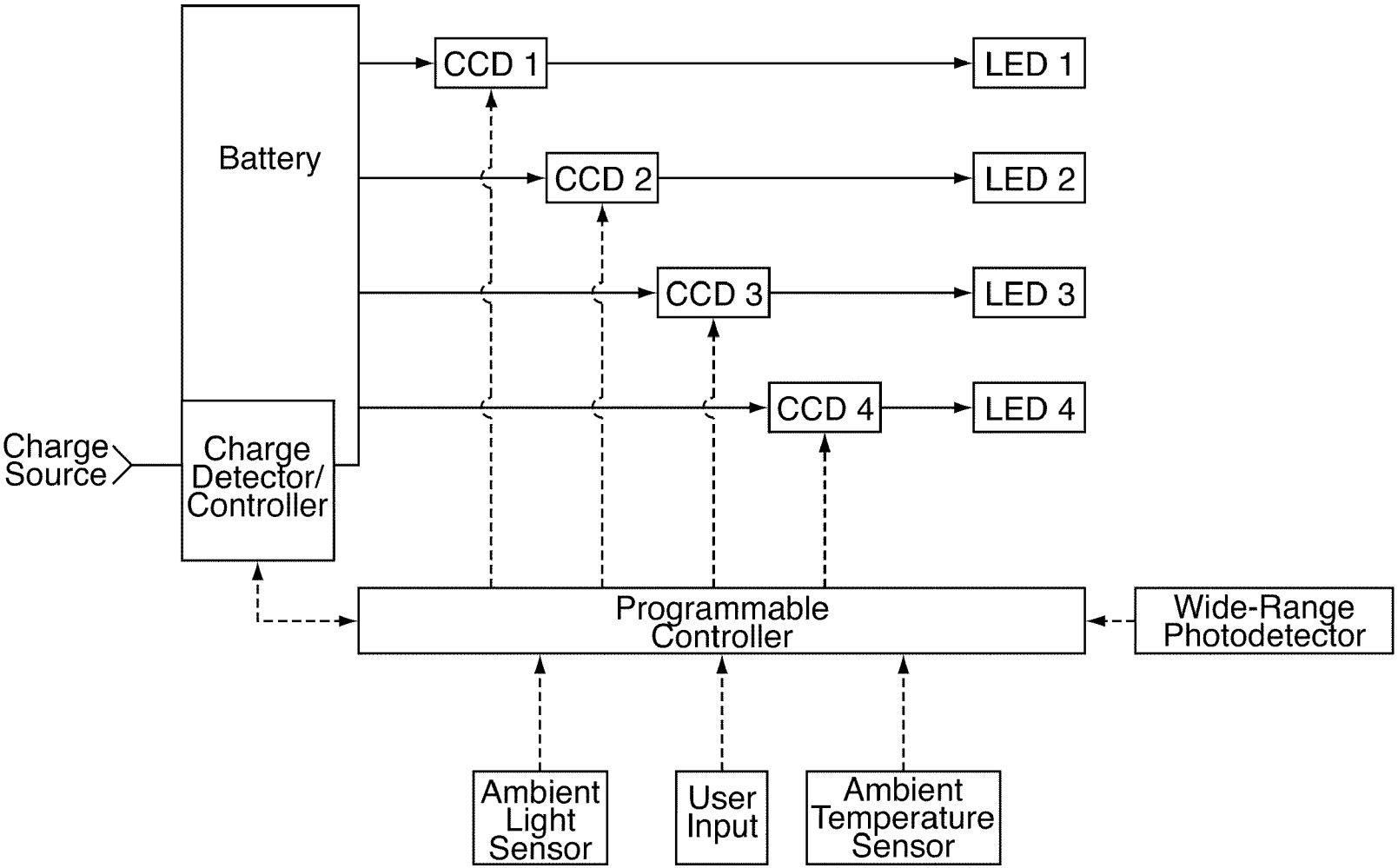
FIG. 4 is a block diagram of a LED lighting system according to an embodiment of the present invention.

Referring to FIG. 4, a block diagram of a light-emitting diode (LED) lighting system is shown according to an embodiment of the present invention. LEDs 1-4 each represent at least 1 LED producing light having a different wavelength. Each constant-current driver (CCD) 1-4 supplies a substantially constant current to its corresponding LED when switched on by a PWM modulated control signal. A power source is provided in the form of a battery. The battery provides power to each CCD 1-4. The battery is provided with a charge detector and controller (detector/controller). The charge detector includes a means for determining the battery state of charge, such a voltmeter, or the like. The charge controller will interact with a charge source, for instance a PV panel (not shown), and the battery to optimize battery charging and discharging. An ambient light sensor, such as a photodiode, phototransistor, a light dependent resistor, or the like, serves as a means for detecting ambient light conditions. In a lighting system employing a PV panel, the PV panel itself is able to serve as an ambient light detection means. An ambient temperature sensor, such as a thermistor, resistance temperature detector, or the like, serves as a means for detecting ambient temperature. A wide-range photodetector serves as a feedback means that detects the actual intensity of LEDs 1-4. A user may also supply inputs.

Figure 5:
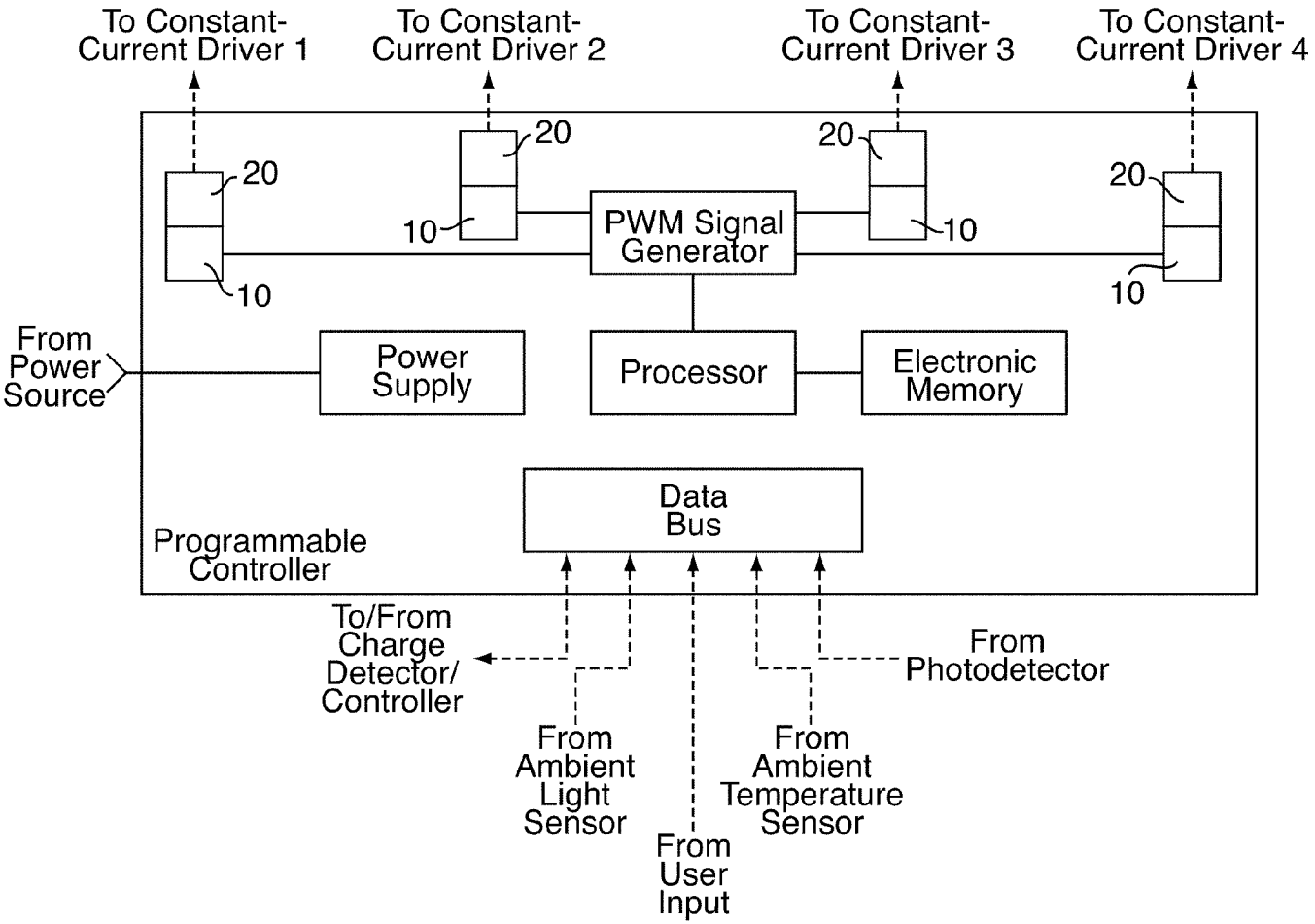
FIG. 5 is a block diagram of the programmable controller of FIG. 4.

The programmable controller (best seen in FIG. 5), includes a processor which executes various routines based user inputs and/or instructions stored in an electronic memory. The various components on the controller are powered by a power supply, which is shown as receiving power from the battery. The data connections to and from the batter charge detector and controller provide the processor with information about the battery's state of charge and allow the processor to control the charging and discharging operations of the battery. (Individual power connections with the programmable controller are well known in the art and not shown.) When directed by the processor, the intensity of each LED is independently adjusted using a PWM control signal generated by PWM signal generators. The PWM signal generator shown is preferably sufficient PWM signal generators to generate independent PWM control signals for each CCD. The PWM control signals are preferably converted into optical signals for transmission over a fiber optic line to each CCD, typically by an emitter 10 in combination with an optical coupler 20. At each CCD the optical signals are converted back into an electrical signal by a photo-detector together with another optical coupler (not shown). This use of optical signals protects against electromagnetic interference with the transmitted signals, thus allowing for a more reliable and efficient transmission of control signals. The processor also receives inputs from a data bus. The charge detector and controller, the ambient light sensor, the ambient temperature sensor, and the wide-range photodetector all communicate information to the data bus, which uses the information in the execution of the various routines. A user may also provide inputs, such as manual intensity adjustments, or selection and/or customization of routines to be executed by the processor.

Preferably, one of the LEDs is selected to produce light (at the current at which the LED is to be operated) having a wavelength substantially corresponding to the peak scotopic sensitivity of the human eye and another is selected to produce light (also at the current at which the LED is to be operated) having a wavelength substantially corresponding to the peak photopic sensitivity of the human eye.

Figure 6:
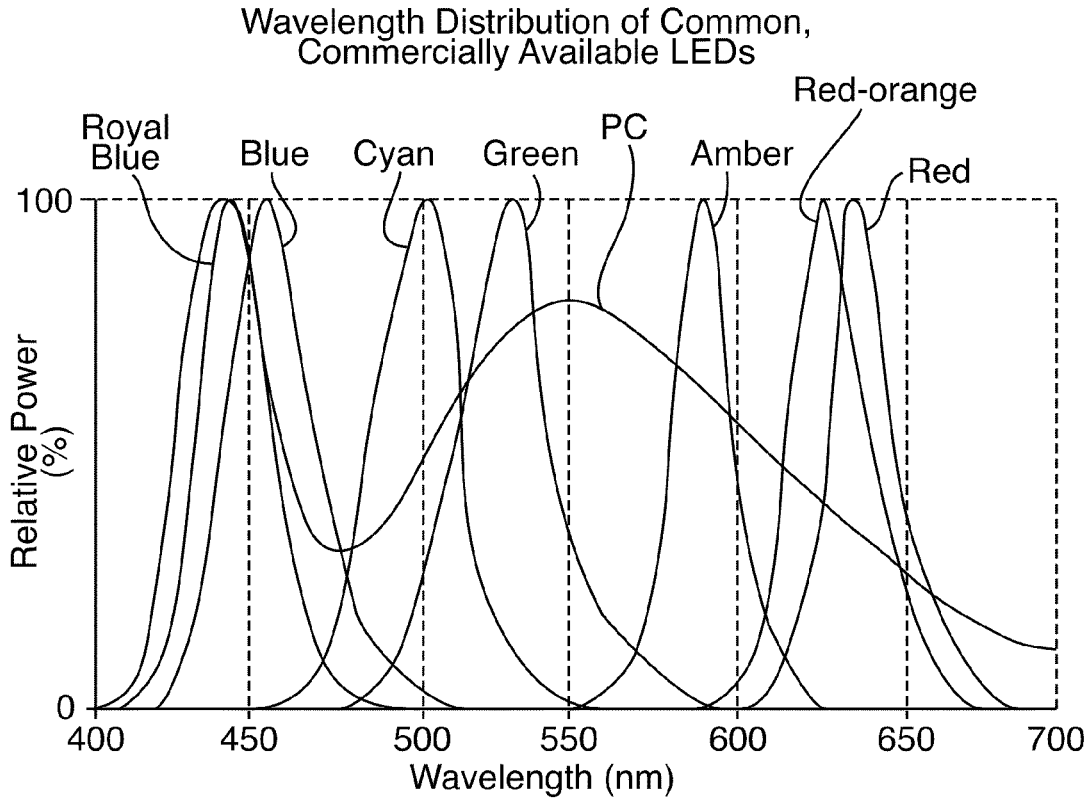
FIG. 6 illustrates the spectrums of common, commercially available LEDs.

Although monochromatic LEDs produce light only within a relatively narrow range of wavelengths (relative to incandescent lights or the sun, for instance), no existing LEDs produce only one discrete wavelength. In terms of currently-available LED colors (see FIG. 6, showing the wavelength characteristics of commonly-available LEDs), a cyan (or blue-green) LED generates light whose spectrum most closely coincides with the scotopic peak of approximately 505 nm. There is a gap in color coverage of monochromatic LEDs around the approximately 555 nm photopic peak. Green LEDs are currently, of the monochromatic LEDs, closest to the photopic peak, however the relatively broad spectrum produced by PC LEDs include wavelengths corresponding much more closely to the photopic peak.

Figure 7:
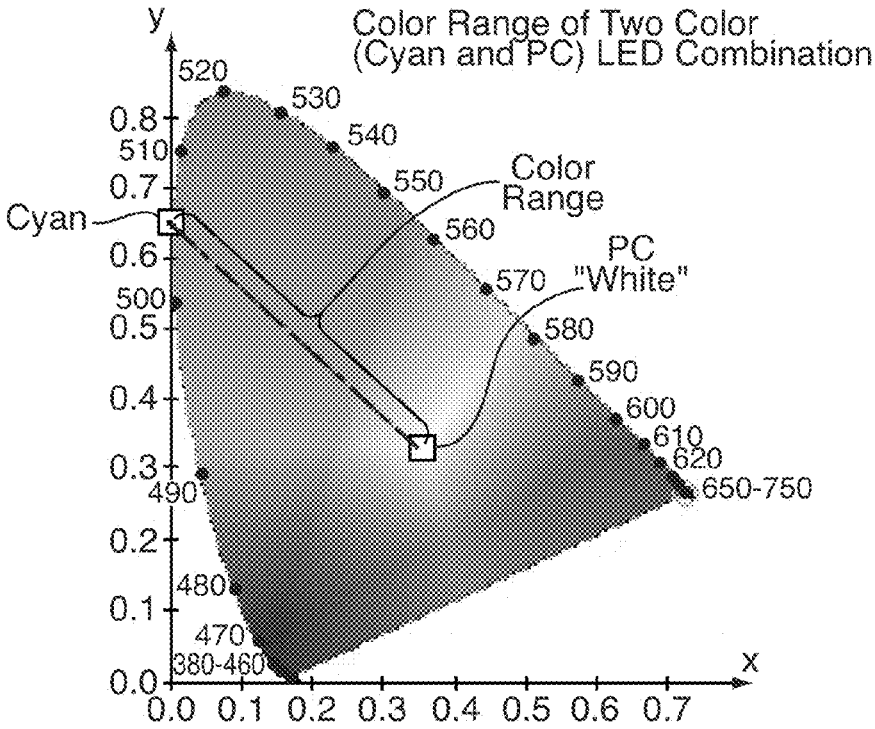
FIG. 7 illustrates the color range of a simulated two-color LED lighting system, according to an aspect of the present invention.
Figure 8:
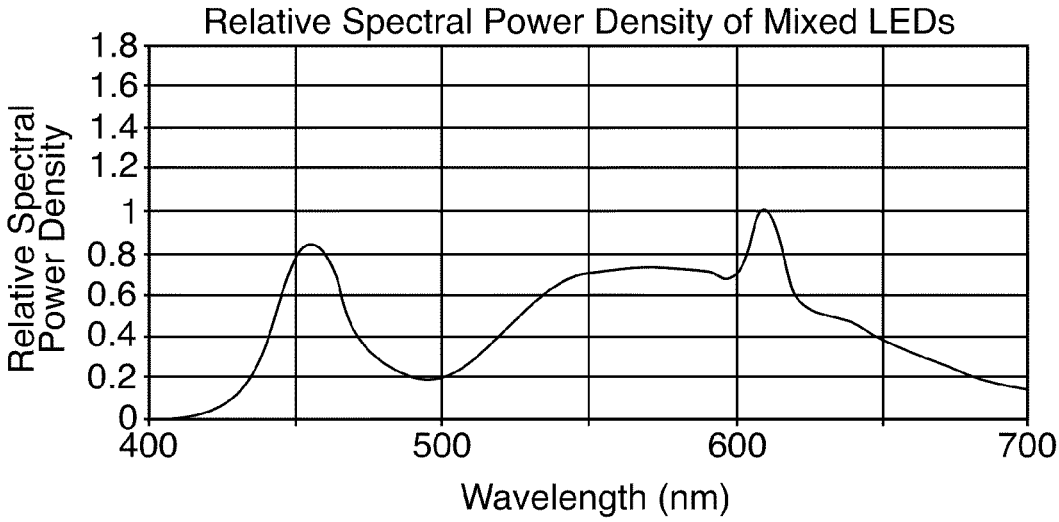
FIG. 8 illustrates the overall spectrum of the two-color LED lighting system of FIG. 7, in one operating state.

In a two-color LED lighting system incorporating these properties, at least one PC LED and at least one cyan LED may be advantageously used. As seen in FIG. 7, a simulated LED lighting system (using a 1931 CIE Chromaticity Diagram, where "x" and "y" are the chromaticity coordinates, as also in FIG. 10, below), by adjusting the relative intensities of the PC and cyan LEDs can produce light having an overall spectrum corresponding to a color anywhere between white to cyan. During photopic ambient conditions, a more optimal operating condition is to operate the PC LED at closer to 100% intensity (where 100% intensity equates to 100% duty cycle at the substantially constant operating current, and 100% intensity does not imply that the LED is being operated at a maximum rated current), and the cyan LED at closer to 0% intensity. Overall, white light is produced generating a spectrum (as seen in FIG. 8), which advantageously includes wavelengths substantially corresponding to the photopic peak sensitivity of the human eye.

Figure 9:
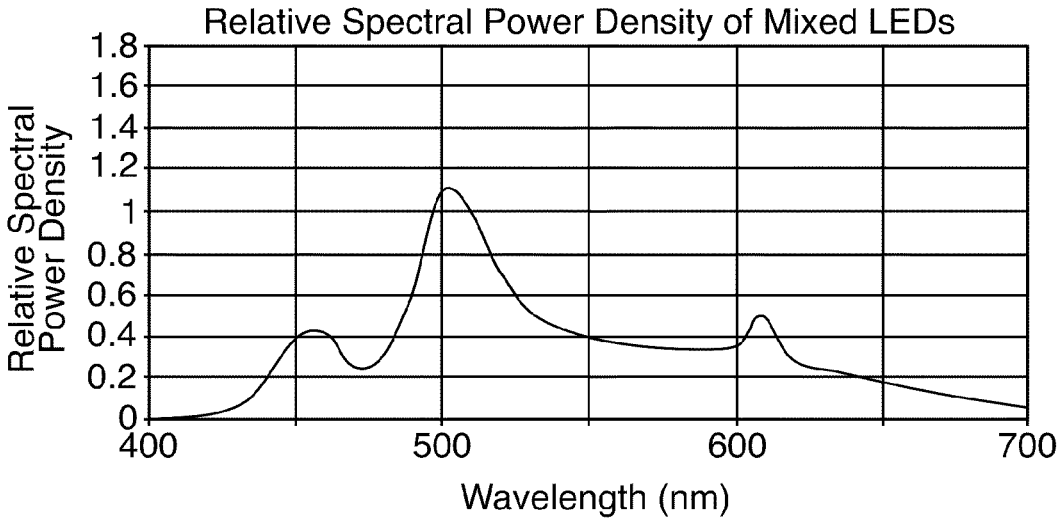
FIG. 9 illustrates the overall spectrum of the two-color LED lighting system of FIG. 7, in another operating state.

Under mesopic or scotopic conditions, the a more effective operating condition is to reduce the PC LED intensity and operate the cyan LED at closer to 100% intensity. This combination results in light tending to have a lower overall intensity and a more cyan color, but achieving a more effective scotopic response in the human eye (as seen in FIG. 9). The combination shown in FIG. 9 is also more efficient to produce because a monochromatic cyan LED requires significantly less power to operate than a PC LED.

Figure 10:
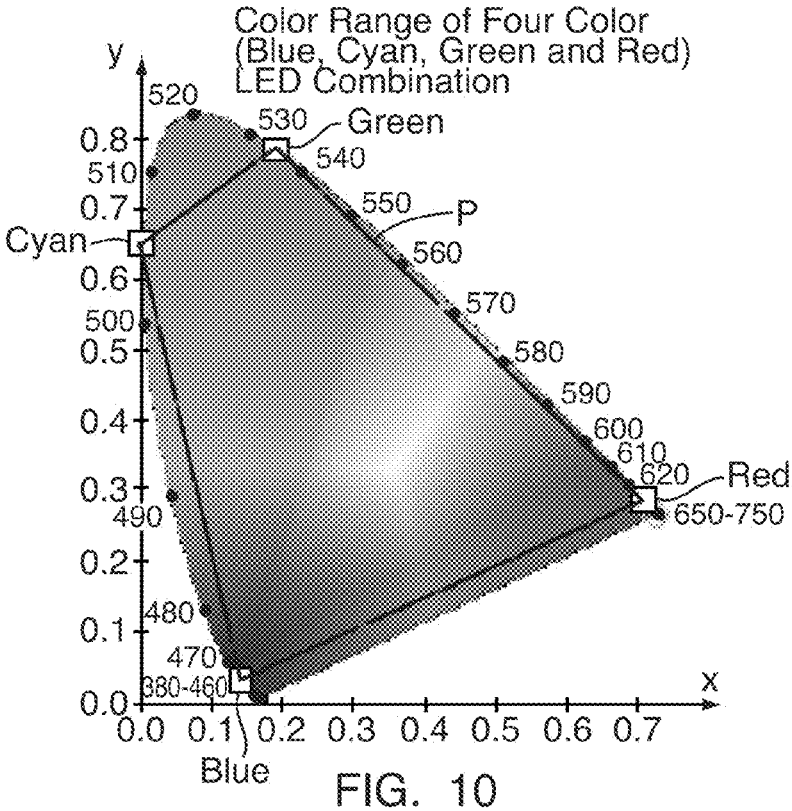
FIG. 10 illustrates the color range of a simulated four-color LED lighting system, according to a further aspect of the present invention.
Figure 11:
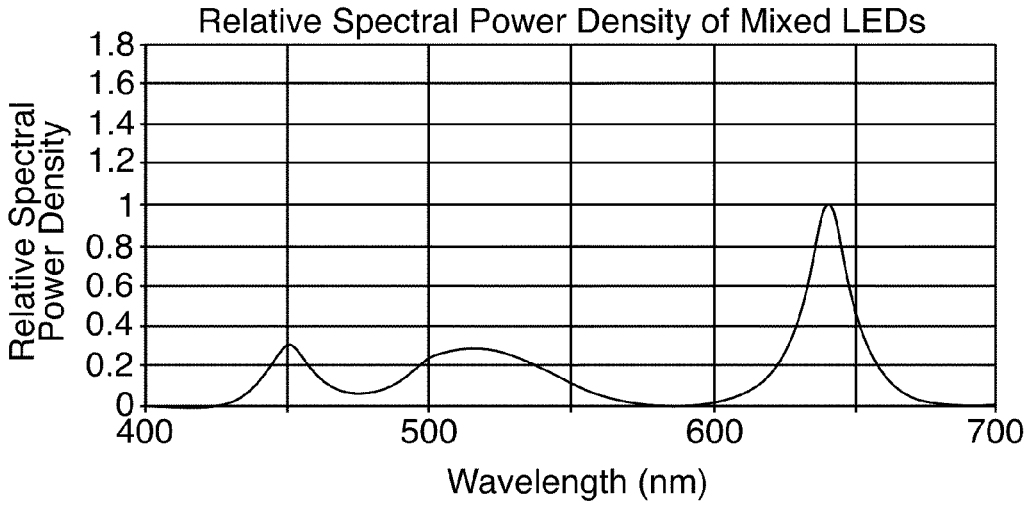
FIG. 11 illustrates the overall spectrum of the four-color LED lighting system of FIG. 10, in one operating state.
Figure 12:
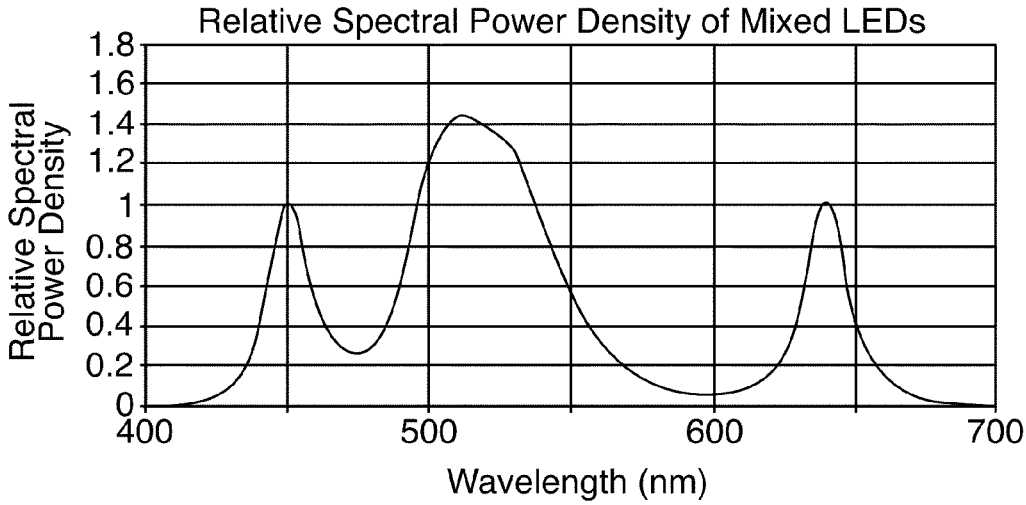
FIG. 12 illustrates the overall spectrum of the four-color LED lighting system of FIG. 10, in another operating state.

In a four-color LED lighting system, a combination of at least one monochromatic LED of each of the colors blue, cyan, green and red may also be advantageously employed. These four colors may be adjusted to maximize scotopic response while exhibiting a greater spectral flexibility. As seen in FIG. 10, a simulated lighting system using the four LEDs in combination can produce an overall spectrum corresponding to any color within the four-sided polygon. Both overall white light can be produced using the four LED colors (as seen in FIG. 11), as well as light with an overall spectrum toward the scotopic peak (as seen in FIG. 12).

During normal operation, the programmable controller performs feedback, intensity, information and/or light adjustment routines by adjusting the duty cycle of the PWM control signal supplied to each CCD. Each CCD is set, for maximum efficiency, to drive each LED at a current below its maximum current capacity. (To achieve a desired overall luminous intensity, enough LEDs of each color would need to be selected to provide the desired overall luminous intensity when operating at a reduced current.) When used with a limited-capacity power source, such as a PV panel and a battery, or the like, this allows a power source of a given capacity to power an LED lighting system with a greater overall luminous intensity, or alternately allows a given overall luminous intensity to be produced using a power source with a lower capacity, or some combination of the two benefits.

Maximum current capacity is used herein to indicate, generally, the current above which a given LED cannot be operated, under a given set of conditions, without risking imminent failure of the LED. LEDs may have more than one maximum current capacity, based upon conditions of use. For instance, an LED may have a higher maximum current capacity when used with a heat sink and a lower maximum current capacity when used without a heat sink. Maximum current capacity is typically determined by the manufacturer of the LED as a maximum rated current or power, but the rated current is empirically determined based on an inherent limitation of the LED, under given operating conditions, and is not an arbitrary current selection. Prior to the present invention, when LEDs (particularly, PC LEDs) were operated at a constant current in a LED lighting system, the universal practice was to set the current level at the maximum current capacity, or the manufacturer's rating. Maximum current capacity is used herein to indicate the manufacturer's current rating of an LED, or if lacking, the actual current capacity for the LED under the LED's operating conditions.

The frequency of the PWM control signal is set sufficiently high to render the switching ON and OFF of the LEDs imperceptible to the human eye, preferably above 100 Hz and most preferably above 1 kHz.

The programmable controller receives feedback on the actual intensity of each LED (or set of LEDs if there are multiple LEDs emitting the same color) using a wide-range photodetector as a feedback means. Multiple, narrow-range photodetectors could be used to discriminate between and measure the intensity of the light produced in each wavelength, but this would greatly increase the cost and is rendered unnecessary by the present invention. In a preferred embodiment, the programmable controller coordinates the duty cycles of each of the PWM control signals, in a feedback routine, to create a brief isolation period for each wavelength of light, during which only LEDs producing the same wavelength are ON. This isolation period is sufficiently brief as to be visually imperceptible.

Figure 13:
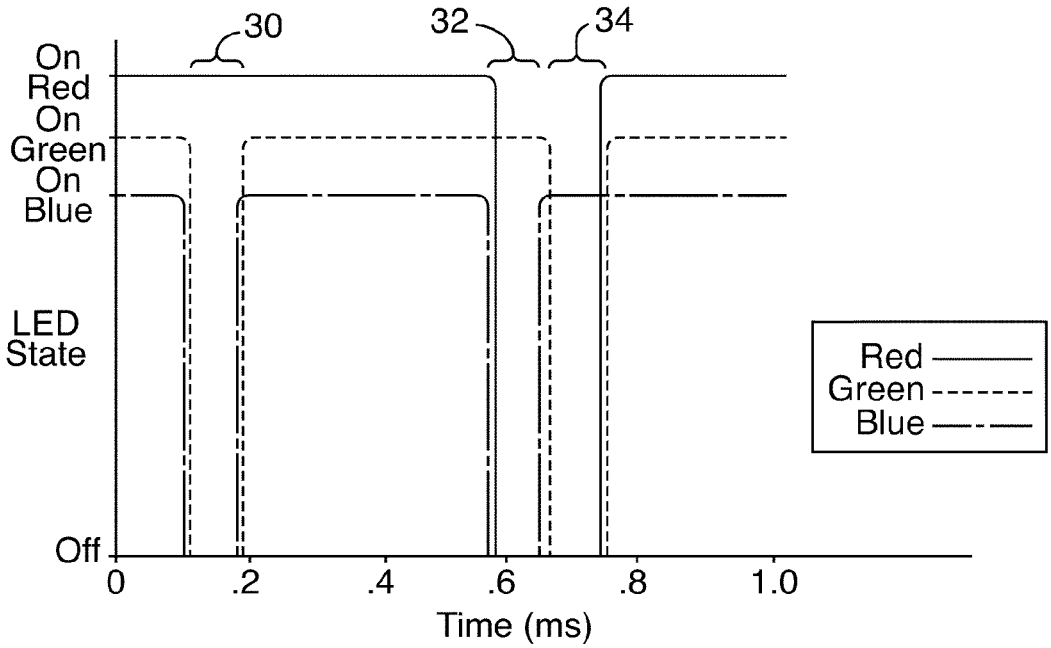
FIG. 13 illustrates an example of a duty-cycle coordination routine, according to an additional aspect of the present invention.

An example of PWM control signal duty cycle coordination incorporating isolation periods for a three-color LED lighting system is shown in FIG. 13. In the example shown, over a 1 ms period each color is cycled ON and OFF. Instead of cycling all three colors ON and OFF simultaneously, the cycles of each color are staggered so that three isolation periods 30, 32 and 34 are generated. In isolation period 30, the green and blue LEDs are OFF and the red LED intensity is independently detected. In isolation periods 32 and 34, respectively, the green and blue LED intensities are detected.

As the LEDs age, a drift in the intensity of LEDs 1-4 will become evident (typically, a decrease in intensity), although the LEDs 1-4 are all being operated at a substantially constant current. As the programmable controller detects the intensity drift of a given LED, it will perform an intensity compensation routine to adjust the duty cycle of the PWM control signal to increase the LED intensity to the desired level, if possible. If the LED cannot produce the desired intensity, even with an 100% duty cycle, it would be necessary to accept the diminished intensity, replace the LEDs, or replace or reset the corresponding CCD to supply a higher constant current.

The ambient light sensor functions as an ambient light detection means. The programmable controller receives ambient light condition information as an input and, in scotopic (dark or night-time) conditions performs a light adjustment routine to adjust the relative intensities of the LEDs such that the overall spectrum of light produced by the LED lighting system will achieve a better scotopic response in the human eye. The adjustment is consistently made in response to the ambient light condition or made in response to the ambient light condition when the battery charge detector (a charge detection means, such as a voltmeter, amp-hour meter, specific gravity probe, or the like) indicates that the battery state of charge has dropped below a pre-determined threshold.

Also in response to an indication that the battery state of charge has dropped below a pre-determined threshold, or independently of such an indication, the programmable controller can enhance the efficiency of the LED lighting system using an efficiency enhancement routine to operate more efficient LED colors at a higher intensity relative to less efficient colors. For example, in a multiple color LED system which includes PC, or "white," LEDs, the PC LEDs will be significantly less efficient than the single color LEDs. The LED lighting system can be run more efficiently by operating the PC LEDs at a lower intensity relative to the other LEDs. Though this will have an effect on the overall spectrum of light produced, this can be an acceptable tradeoff for enhanced efficiency, and correspondingly, longer battery life. The overall intensity can be maintained constant, if desired, by increasing the intensity of the more efficient LEDs to compensate for the decreased intensity of the less efficient LEDs. An enhanced efficiency will still result.

In addition to intensity adjustments related to efficiency and/or effectiveness of the light produced, the programmable controller also includes an information routine to adjust the LED intensities to convey information to a user of the LED lighting system. For example, the relative intensities may be adjusted to flash a visually detectable color to indicate a pending system fault, such as a low detected state of charge. The programmable controller receives temperature information from the temperature sensor (an ambient temperature detection means) and changes the overall spectrum of light produced to indicate the temperature. An exemplary use of this aspect of an LED lighting system is a street light which normally produces white light when the temperature is above the freezing point of water, but produces red (or blue) light when the temperature drops below freezing, thus alerting drivers to a potentially hazardous road condition. A calendar in the electronic memory also enables the programmable controller to vary the light color for certain times of year, for instance orange for Halloween and green for Christmas.

In a preferred embodiment, the charge controller for controlling the battery charge (or the programmable controller acting as a charge controller) includes an MPPT routine in connection with a PV panel for charging the battery. Until the present invention, it was believed that use of MPPT in low current applications was not warranted by the relatively small efficiency gains. An MPPT routine maximizes the charging rate in sub-optimal charging conditions, where the voltage level at maximum power output from the power source does not match the optimal battery charging voltage. In solar-powered lighting applications, sub-optimal charging conditions typically coincide with darker, colder days. The inventors of the present invention have found that, in limited-capacity power source-powered (particularly solar-powered) lighting applications, the efficiency gains of MPPT are more significant, precisely because MPPT is most effective in combination with a PV panel and battery on the darkest, coldest days (for example, the December to February time frame for the Northern hemisphere). On those same days the usage of LED lighting systems tends to be the greatest (as the nights are longest), resulting in a maximized charging capacity when that capacity may be most readily utilized.

It will be dear to those skilled in the art that the present invention is not limited to the embodiments described, and that many of the features of the present invention may be advantageously applied to LED lighting systems alone or in combination and that many variations or modifications for existing circumstances can be made without departing from the scope of the invention. Though not exhaustive, some variations are described below.

Within the scope of the method for selecting an optimal quantity of LEDs for an LED lighting system, various costs of LEDs, costs associated with adding LEDs (such as associated circuitry costs), and power source costs beyond those enumerated may be considered when determining costs for various LED quantities and power source costs corresponding to the various LED quantities. The method of the present invention is not limited to any particular expression of costs, but various expressions of the costs considered may be employed The present invention is not limited to a particular number of LEDs, such a LEDs 1-4, shown. Any number of different LEDs can be controlled, limited by the output capabilities of the programmable controller selected. Each intensity adjustment means can adjust a single LED, though typically a series string of LEDs in controlled by a single CCD. It is also preferred that LEDs producing the same color be controlled together, but different colors can be controlled together. Various combinations of LED colors can be used, in addition to those enumerated herein. The number of colors and, colors themselves can be chosen based on correspondence with the applicable sensitivity (e.g. scotopic, mesopic, photopic) of the eye based on the lighting application and/or user preference, or other factors.

The current adjustment means is not limited to a CCD. Other well-known means for adjusting the characteristics of power supplied to a load can be employed, such as voltage divider circuits with variable resistors, or the like. Additionally, while it is preferred to use optical communications to reduce interference with signals transmitted over longer distances, the present invention encompasses more conventional communications means, such as electrical transmission of control signals, and the like.

The present invention is also not limited to a particular type of programmable controller. Controllers from relatively simple programmable logic controllers to advanced microprocessors, or the like, can be used, depending of factors like the number of inputs to be used, the complexity and quantity of routines to be executed, and the level of user interface desired. The various names of routines are only indicative of the functional capabilities of the programmable controller. Hence, a routine (defined as a set of machine-executable instructions) is included in a programmable controller, if it enables the controller to execute the functions described herein. The term "programmable" does not necessarily imply a capability of repeated programming or on-going user modification, but includes controllers which have only initial, preset programming.

These and other variations and modifications may all be made within the scope of the present invention.

What is claimed is:

1. An LED lighting system emitting light having an overall intensity, said system comprising:

a plurality of LEDs each having a maximum current capacity;

at least one constant-current driver for supplying a substantially constant current to said plurality of LEDs, said at least one constant-current driver being set to supply said constant current at a level less than said maximum current capacity, wherein said level of constant current to each of said plurality of LEDs is less than approximately 50% of said maximum current capacity for said LEDs; and whereby luminous efficiency of said LED lighting system is increased without decreasing said overall intensity of said light.

2. An LED lighting system producing light having an overall spectrum, said system comprising:

a first LED producing light having a first spectrum and an adjustable first intensity;

a second LED producing light having a second spectrum and an adjustable second intensity;

a programmable controller for independently adjusting said first and second intensities; and a light detection means for detecting an ambient light condition; and a battery for supplying power to said LED lighting system; and a charge detection means for determining a state of charge of said battery and communicating said state of charge to said programmable controller;

wherein said programmable controller includes a spectrum adjustment routine for adjusting at least one of said first and second adjustable intensities to adjust said overall spectrum in response to said ambient light condition and wherein said programmable controller performs said spectrum adjustment routine when said state of charge falls below a pre-determined threshold.

3. The system of claim 2, wherein said programmable controller performs said spectrum adjustment routine to adjust said overall spectrum to substantially correspond to at least one of a peak scotopic and a peak photopic condition of a human eye, to reduce energy demands of said LEDs.

4. An LED lighting system comprising:

at least one LED having a maximum current capacity; and at least one constant-current driver for supplying a substantially constant current to said at least one LED, said at least one constant-current driver being set to supply said constant current at a level less than said maximum current capacity, wherein said level of constant current to each of said at least one LED is less than approximately 50% of said maximum current capacity for said LED; and whereby luminous efficiency of said LED lighting system is increased, wherein said maximum luminous intensity of said system is increased by adding additional LEDs, each of said additional LEDs operating at less than approximately 50% of said maximum current capacity for said additional LEDs.

5. The system of claim 4, further comprising a programmable controller including a PWM signal generator for generating a PWM control signal and supplying said PWM control signal to said constant-current driver, wherein said constant-current driver supplies said substantially constant current in response to said PWM control signal.

6. The system of claim 4, wherein said constant-current driver is set to supply said constant current at less than approximately 35% of said maximum current capacity.

7. An LED lighting system comprising:

a first LED producing light having a first spectrum substantially corresponding to one of a peak scotopic and a peak photopic sensitivity of a human eye; and a second LED producing light having a second spectrum; and wherein said system reduces power demands by providing either said first spectrum or said second spectrum depending upon which is most effective for vision in either scotopic or photopic ambient conditions.

8. The LED lighting system of claim 7, further comprising a third LED and a fourth LED, and wherein said first LED is a cyan LED, said second LED is a blue LED, said third LED is a green LED, and said fourth LED is a red LED.

9. The LED lighting system of claim 7, wherein said first spectrum substantially corresponds to said peak scotopic sensitivity and said second spectrum includes wavelengths substantially corresponding to said peak photopic sensitivity.

10. The LED lighting system of claim 9, wherein said first LED is a cyan LED and said second LED is a PC LED.

11. An LED lighting system producing light having an overall spectrum, said system comprising:

a first LED producing light having a first spectrum and an adjustable first intensity;

a second LED producing light having a second spectrum and an adjustable second intensity;

a programmable controller for independently adjusting said first and second intensities;

a first constant-current driver for supplying a first constant current to said first LED in response to a first PWM control signal; and a second constant-current driver for supplying a second constant current to said second LED in response to a second PWM control signal;

wherein said programmable controller generates said first and second PWM control signals and supplies said first and second PWM control signals to said first and second constant-current drivers, respectively, and said programmable controller independently adjusts said first and second intensities by independently adjusting said first and second PWM control signals; and wherein said programmable controller actively and continuously reduces energy demands of said LEDs by shifting said overall spectrum to a most efficient spectrum of one of said first and second spectrums for a given ambient condition.

12. The system of claim 11, further comprising:

a wide-range photodetector for detecting an actual first intensity and an actual second intensity of said first and second LEDs, respectively;

wherein said programmable controller includes a feedback routine for coordinating said first and second PWM control signals such that a first isolation period periodically occurs when only said first LED is operated and a second isolation period periodically occurs when only said second LED is operated, so as to enable said wide-range photodetector to independently detect said actual first and second intensities.

13. The system of claim 11, wherein said programmable controller includes an information routine for adjusting at least one of said first and second intensities to convey information to a user of said system by said system.

14. The system of claim 1, wherein said first LED has a greater luminous efficiency than said second LED, and said programmable controller includes an efficiency enhancement routine for increasing an overall efficiency of said LED lighting system by operating said first LED at a higher intensity relative to said second LED.

15. The system of claim 14, further comprising:

a battery for supplying power to said LED lighting system; and a charge detection means for determining a state of charge of said battery and communicating said state of charge to said programmable controller;

wherein said programmable controller controls performs said efficiency enhancement routine when said state of charge falls below a pre-determined threshold.

16. The system of claim 11, further comprising:

a feedback means for independently detecting an actual first intensity and an actual second intensity of said first and second LEDs, respectively, and communicating said actual first and second intensities to said programmable controller;

wherein said programmable controller includes a feedback routine for using said actual first and second intensities as feedback for adjusting said adjustable first and second intensities.

17. The system of claim 16, wherein said feedback means is a wide-range photodetector and said feedback routine enables said wide-range photodetector to independently detect said actual first and second intensities by controlling said first and second LEDs to conduct a first isolation period when only said first LED is operated and a second isolation period when only said second LED is operated.

18. The system of claim 17, wherein said programmable controller rapidly conducts said first and second isolation periods so as to make said first and second isolation periods visually undetectable.

* * * * *